US007234248B2

(12) United States Patent
Kelley

(10) Patent No.: US 7,234,248 B2
(45) Date of Patent: Jun. 26, 2007

(54) FOOTWEAR

(75) Inventor: Thomas Jeffrey Kelley, San Diego, CA (US)

(73) Assignee: Sanuk USA, LLC., Cardiff by the Sea, CA (US)

( * ) Notice: Subject to any disclaimer, the term of this patent is extended or adjusted under 35 U.S.C. 154(b) by 99 days.

(21) Appl. No.: 11/074,110

(22) Filed: Mar. 7, 2005

(65) Prior Publication Data

US 2006/0196080 A1 Sep. 7, 2006

(51) Int. Cl.
*A43B 13/00* (2006.01)

(52) U.S. Cl. ..... 36/22 R; 12/146 BC

(58) Field of Classification Search ..... 36/11.5, 36/12, 19.5, 22 R, 23; 12/142 F, 142 RS, 12/142 T, 146 BP, 146 BC
See application file for complete search history.

(56) References Cited

U.S. PATENT DOCUMENTS 2,245,706 A * 6/1941 Nutt ..... 12/146 R
2,297,594 A * 9/1942 Weinstat ..... 36/19.5
2,297,595 A * 9/1942 Weinstat ..... 36/11.5
2,368,314 A * 1/1945 Marx ..... 36/11.5
2,434,024 A * 1/1948 Vlasak ..... 36/11.5
2,538,170 A * 1/1951 Stritter ..... 36/16
5,991,950 A * 11/1999 Schenkel ..... 12/142 T

* cited by examiner

*Primary Examiner*—Ted Kavanaugh
(74) *Attorney, Agent, or Firm*—Greer, Burns & Crain, Ltd.

(57) ABSTRACT

Footwear having a shoe upper and a sandal type sole are made from an upper having a lower marginal edge with a plurality of spaced fingers extending from the lower marginal edge, a footbed having a peripheral edge and a plurality of spaced slots therethrough adjacent the peripheral edge and aligned respectively with the fingers, the fingers being extended through the slots and folded over onto the lower surface of the foot bed, an outsole secured to the lower surface of the footbed and the folded portions of the fingers and securing the fingers between the footbed and the outsole, and a structural arrangement for concealing from view the lower marginal edge and the fingers of the upper. A mid-sole is optionally provided between the footbed and the outsole. A method of making the footwear is described.

11 Claims, 3 Drawing Sheets

FOOTWEAR

The present invention relates to footwear, especially footwear having a full upper, e.g., a shoe upper, and a sandal type sole.

BACKGROUND

Sandals are a very comfortable, and usually inexpensive, form of footwear comprised of a sole and one or more straps for holding the sole to the plantar surface of a wearer's foot. For enhanced comfort and attractiveness, the upper surface of the sole may also be provided with a foot bed engageable with the plantar surface of the wearer's foot as shown, for example, in U.S. Pat. Nos. D-429,555 and 6,811,734.

However, in cold and/or inclement conditions, sandals are not a practical form of footwear because they do not protect the wearer's foot from the wet and cold. Even if worn with socks, which can be quite unsightly, sandals do not provide sufficient protection from the wet and cold and, of course, are totally impractical in snow.

SUMMARY OF THE INVENTION

The object of the invention is to embody the comfort of a sandal into a shoe or slipper or slip-on shoe having a full upper, i.e., one that covers the toes and instep and, preferably though optionally, the heel of the wearer's foot.

Another object of the invention is to provide an improved shoe construction and an improved method of making shoes comprised of a full upper and a sandal type sole.

In accordance with the invention, a shoe is comprised of an upper, a footbed or sock liner, an outer or out sole, and means for concealing the mode of assembly of the same. In preferred embodiments, a mid-sole or sock liner is provided between the footbed and the outsole.

More particularly, the shoe of the invention is comprised of a full upper having a lower marginal edge with a plurality of spaced fingers or tabs extending downwardly from the lower marginal edge, a footbed or sock liner having a plurality of spaced slots or openings therein for receiving the fingers or tabs of the upper, the fingers or tabs being folded under and secured to the lower surface of the footbed, an outsole secured to the lower surface of the footbed and confining the fingers or tabs between the footbed and the outsole, and means extending around the periphery of the footbed and the lower margins of the upper for concealing the connection between the upper and the footbed.

In one embodiment, the concealing means comprises a marginal rib extending around the periphery of the footbed. In another embodiment, the concealing means comprises a foxing strip extending around the periphery of the lower margins of the shoe.

In preferred embodiments, a mid-sole, preferably of the same material as the footbed, is installed between and secured to the footbed and the outsole and the stitch-down board required in conventional shoes is eliminated.

The invention thus provides a very comfortable, economical and attractive shoe having a full upper.

These and other objects and advantages of the invention will become apparent to those of reasonable skill in the art from the following detailed description, as considered in conjunction with the accompanying drawings.

BRIEF DESCRIPTIONS OF THE DRAWINGS

Figure 6A:
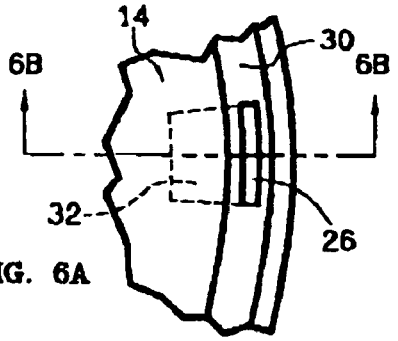
Figure 6B:
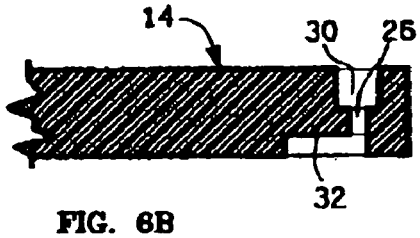
Figure 7A:
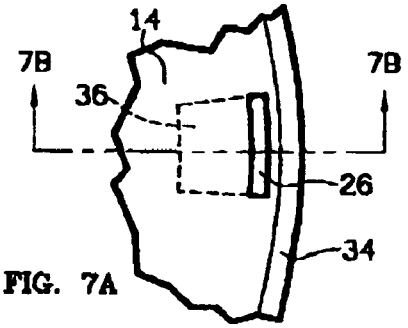
Figure 7B:
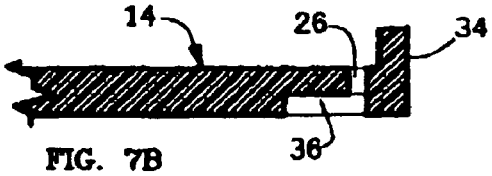
Figure 8A:
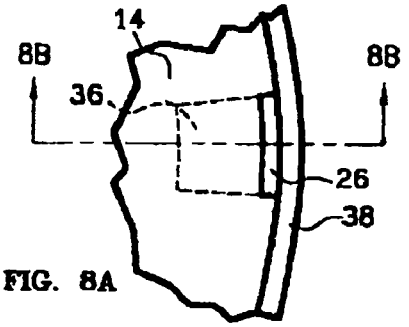
Figure 8B:
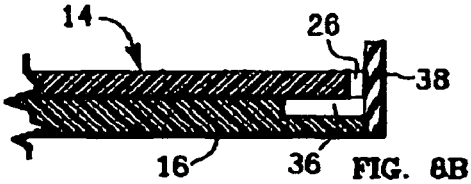
Figure 9:
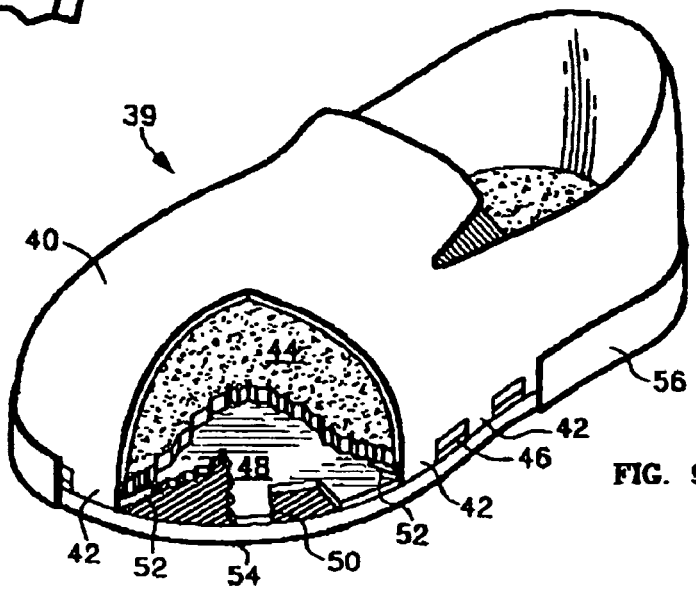

FIGS. 6*a* and 6*b* are, respectively, a fragmentary plan view and a fragmentary cross-section of one embodiment of a footbed of the invention providing a groove for receiving and concealing the lower margins of the upper;

FIGS. 7*a* and 7*b* are, respectively, a fragmentary plan view and a fragmentary cross-section of a second embodiment of a footbed of the invention providing a peripheral rib for receiving and concealing the lower margins of the upper;

FIGS. 8*a* and 8*b* are, respectively, a fragmentary plan view and a fragmentary cross-section of an embodiment of the invention comprised of a footbed and a mating mid-sole and including a foxing strip for concealing the lower marginal edges of the upper and the marginal edges of the footbed and mid-sole; and FIG. 9 is a perspective view, with portions broken away, of a shoe incorporating the embodiment of the invention shown in FIGS. 8*a* and 8*b*.

DETAILED DESCRIPTION OF PREFERRED EMBODIMENTS

The following is a detailed description of certain embodiments of the invention presently contemplated by the inventor to be the best mode of carrying out his invention.

Figure 1:
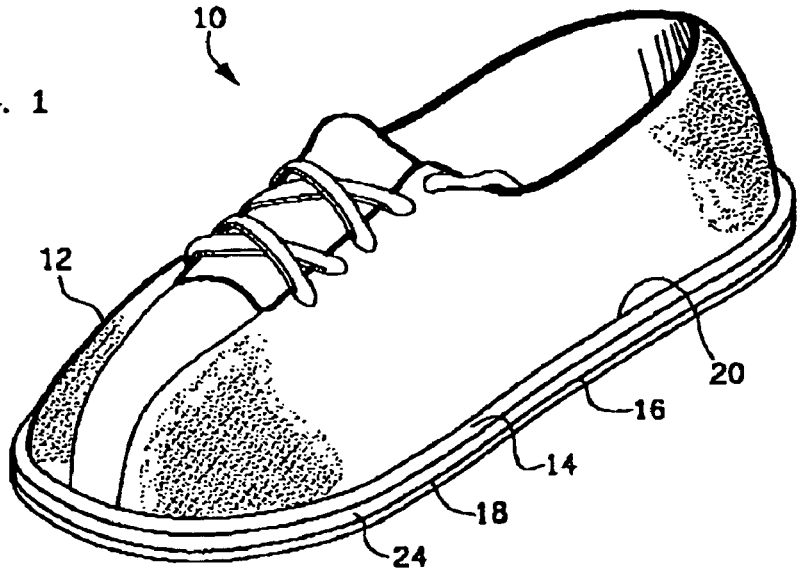
FIG. 1 is a perspective view of one embodiment of a shoe made in accordance with the invention.
Figure 2:
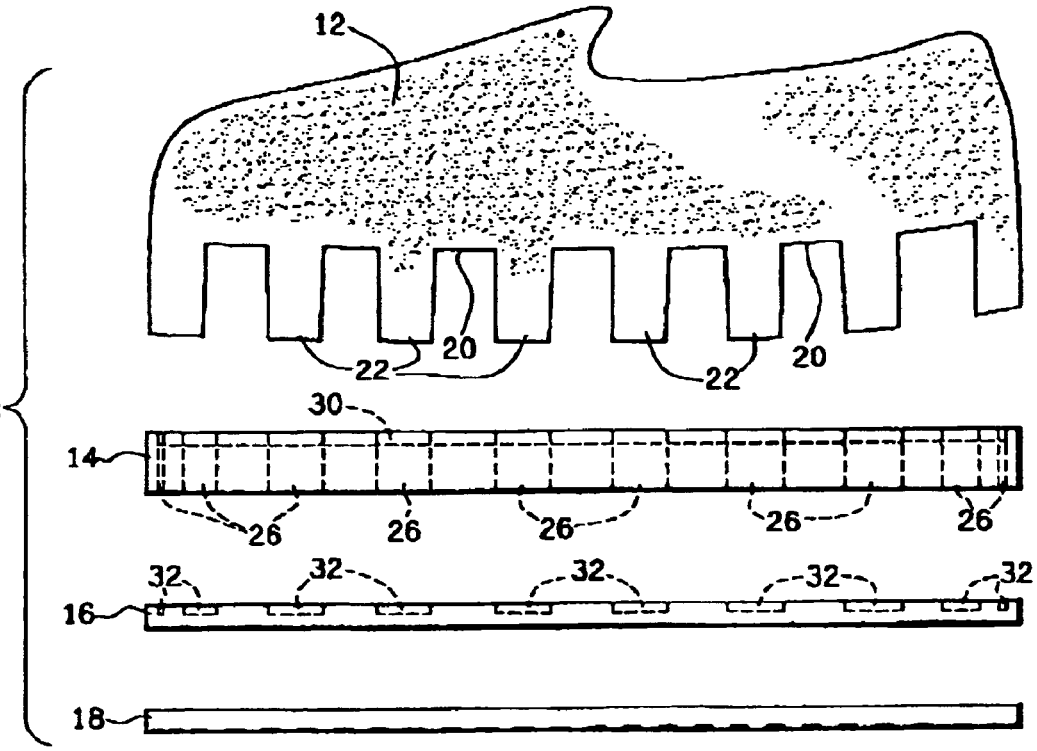
FIG. 2 is an exploded side view of the components of the shoe shown in FIG. 1.
Figure 3:
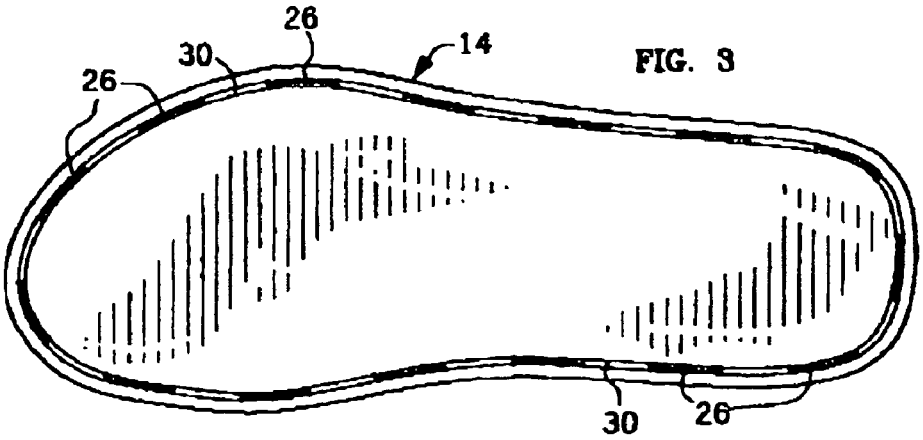
FIG. 3 is a top plan view of the footbed of FIG. 2.

Referring to FIGS. 1, 2 and 3, a shoe 10 made in accordance with the invention is comprised of an upper 12, a footbed or sock liner 14, preferably but optionally a mid-sole 16 and an outsole 18.

The upper 12 may be any conventional shoe upper, such as a lace up full shoe upper that covers the toes, instep and heel, a slip-on upper, i.e., without a heel, a loafer upper, a moccasin upper, a slipper upper and even a boot upper. The upper 12 has a lower marginal edge 20 and a plurality of spaced fingers or tabs 22 extending from the edge 20 around the periphery of the edge.

The footbed or sock liner 14, herein referred to as footbed, may comprise any material customarily used for footbeds and is preferably cushiony material consistent with sandal design and construction. The footbed has a peripheral edge 24 and a plurality of spaced slots 26 extending through the footbed adjacent the peripheral edge and aligned respectively with the fingers 22 on the upper 12.

Figure 4:
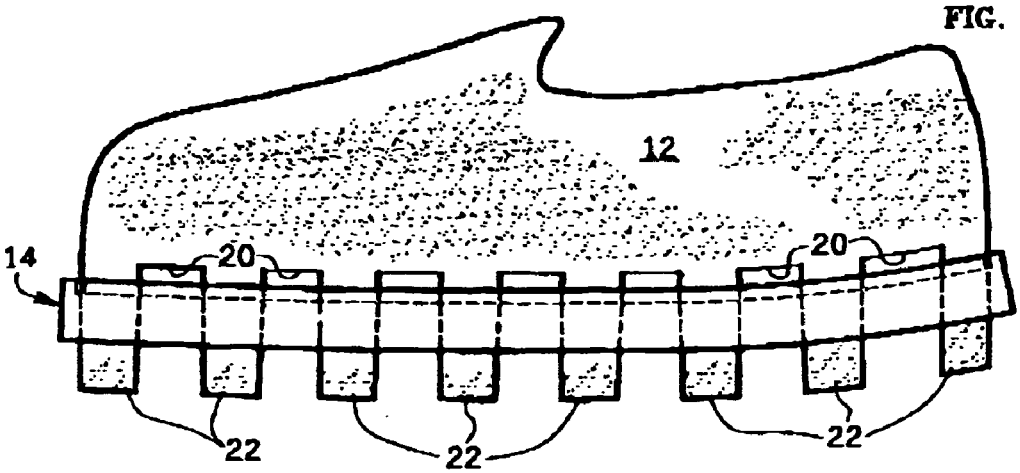
FIG. 4 is a side elevation illustrating the assembly of an upper and a footbed.
Figure 5:
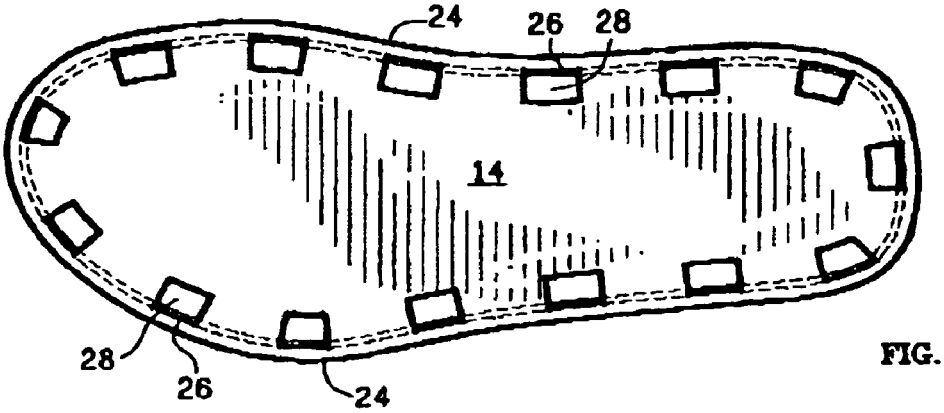
FIG. 5 is a bottom view of a footbed showing the fingers of the upper folded onto the lower surface of the footbed.

As shown in FIGS. 4 and 5, the fingers 22 on the upper 12 are of a length greater than the thickness of the footbed 14 and are extended through the slots 26 in the footbed (FIG. 4) and the end portions 28 thereof are folded over against the lower surface of the footbed 14 (FIG. 5). The end portions 28 of the fingers may be and preferably are adhered to the lower surface of the footbed.

The mid-sole 16, if employed, is preferably comprised of the same material as the footbed. It has an upper surface and a lower surface and is adhered at its upper surface to the lower surface of the footbed 14 and the folded end portions 28 of the fingers 22, thereby to secure the finger end portions 28 between the footbed and the mid-sole. Use of the same materials for the lower surface of the footbed and the upper surface of the mid-sole or outsole ensures an extremely secure bond between the two, and thus a highly reliable securement of the finger end portions within the shoe. This results in a very economical way of securing an upper to a sole structure and eliminates the need for the stitchdown board required in most conventional full shoe constructions.

The outsole 18 may be made of any conventional outsole material and has a lower ground engaging surface and an upper surface adhered to the lower surface of the mid-sole 16. If the mid-sole is omitted from the structure, as is permissible, the upper surface of the outsole is preferably comprised of the same material as the footbed and is adhered directly to the lower surface of the footbed 14 and the folded over end portions 28 of the fingers 22 to confine and secure the fingers between the footbed and the outsole.

Absent further considerations, the shoe as thus far described would reveal a stepped lower margin on the upper and the marginal portions of the upper between the fingers 22 would not be adhered to the footbed. Thus, means for covering, concealing and sealing the marginal edges of the upper to the footbed are important and the present invention provides several solutions, as illustrated in FIGS. 6, 7 and 8.

FIGS. 6*a* and 6*b* illustrate a construction wherein a groove 30 is provided in the upper surface of the footbed 14 adjacent and extending continuously around the peripheral edge of the footbed. The slots 26 are formed in the base of the groove 30. Thus, when the fingers 22 are pulled through the slots 26, the lower marginal edges of the upper are pulled into the groove to cover and conceal the marginal edges and fingers of the upper. Additionally, the lower marginal edge of the upper may be adhered e.g., with glue or sealant, within the groove thereby to seal the upper to the footbed.

If desired, a recess 32 maybe formed in the lower surface of the footbed for reception of the folded end of a respective finger extended through a respective slot 26. Alternatively, the recess 32 could be provided in the upper surface of the mid-sole.

FIGS. 7*a* and 7*b* illustrate a modification wherein the footbed 14 includes an upstanding peripheral rib 34 extending around its peripheral edge outwardly of the slots 26 within which the lower marginal edges and fingers of the upper are received and to which they may be adhered, thereby to seal the upper to the footbed. Again, a recess 36 may be provided in the footbed or mid-sole for reception of the folded end portion of a respective finger.

FIGS. 8*a* and 8*b* illustrate a further embodiment wherein slots 26 are formed directly at or in the peripheral edge of a footbed 14, a mid-sole 16 has a recess 36 for receiving the end portion of a respective finger extending inwardly through the peripheral edge of the footbed and the laterally or outwardly open ends of the slot and recess and the lower margins of the upper are covered and concealed by a strip 38, called a foxing strip, adhered and sealed to the marginal edges of the mid-sole, footbed and upper.

Thus, in any of these ways, the lower marginal edges of the upper may be covered and sealed to the footbed and concealed from view.

FIG. 9 illustrates another embodiment of a shoe 39 made in accordance with the invention which employs the covering, concealing and sealing structure of FIGS. 8*a* and 8*b*. The shoe 39 is comprised of an upper 40 having a lower marginal edge and spaced fingers 42 extending from the edge; a sock liner or a footbed 44 having a peripheral edge with outwardly open spaced notches of slots 46 at or in it peripheral edge, which are aligned respectively with the fingers 42; a mid-sole 48 having a peripheral edge with outwardly open recesses 50 in the edge, which are aligned respectively with the slots 46 and the fingers 42, for receiving the folded end portions 52 of the fingers; an outsole 54; and a foxing strip 56 extending around and sealed to the periphery of the shoe and covering the lower marginal portions of the upper 40 and the fingers 42, the peripheral edges of the footbed 44 and mid-sole 48, and part or all of the peripheral edge of the outsole 54.

The assembly of the shoe 39 is carried out in substantially the same manner as above described for the shoe 10.

The assembly produces footwear wherein all of the components are adhered and sealed together in a very efficient, economical and practical manner to produce footwear that are very comfortable, practicable, and usually economical.

The objects and advantages of the invention have therefore been shown to be attained in a convenient, practical, economical and facile manner.

While preferred embodiments of the invention have been herein illustrated and described, it is to be appreciated that various modifications, rearrangements and variations may be made therein without departing from the scope of the invention as defined by the appended claims.

What is claimed is:

1. Footwear comprising an upper having a lower marginal edge and a plurality of spaced fingers extending from said marginal edge, a footbed having upper and lower surfaces, a peripheral edge, a groove in said upper surface adjacent and extending around said peripheral edge, and a plurality of spaced slots aligned respectively with said fingers and extending through the footbed from a base of said groove to said lower surface of the footbed, said fingers extending through respective slots and having portions folded onto the lower surface of said footbed, and an outsole having an upper surface secured to the lower surface of said footbed and securing the folded portions of said fingers between the lower surface of said footbed and the upper surface of said outsole, said groove receiving, covering and concealing said fingers and the lower marginal edge of said upper.

2. Footwear as set forth in claim 1 wherein said groove extends continuously around the peripheral edge of the footbed.

3. Footwear as set forth in claim 1 wherein said upper comprises a full shoe upper.

4. Footwear as set forth in claim 1 wherein said upper comprises a slip-on shoe upper.

5. Footwear as set forth in claim 1 including a mid-sole positioned between and secured to said footbed, said folded portions of said fingers and said outsole.

6. Footwear as set forth in claim 5 wherein at least one of said footbed and said mid-sole has recesses therein for receiving the folded portions of said fingers.

7. Footwear comprising a full shoe upper having a lower marginal edge and a plurality of spaced fingers extending from said marginal edge, a footbed having upper and lower surfaces, a peripheral edge, a groove in said upper surface adjacent and extending around said peripheral edge, and a plurality of spaced slots aligned respectively with said fingers and extending through the footbed from a base of said groove to said lower surface of the footbed, said fingers extending through respective slots and having portions folded onto the lower surface of said footbed, and a mid-sole having an upper surface secured to the lower surface of said footbed and the folded portions of said fingers and securing the folded portions of said fingers between the lower surface of said footbed and the upper surface of said mid-sole, said groove receiving, covering and concealing said fingers and the lower marginal edge of said upper.

8. Footwear as set forth in claim 7 wherein said groove extends continuously around the peripheral edge of the footbed.

9. A method of making footwear comprising the steps of providing a shoe upper having a lower marginal edge and including spaced fingers extending from said marginal edge, providing a footbed having upper and lower surfaces, a peripheral edge, a groove in said upper surface adjacent and extending around said peripheral edge, and a plurality of spaced slots aligned respectively with said fingers and extending through the footbed from a base of said groove to said lower surface of the footbed, providing an outsole having upper and lower surfaces, positioning the lower marginal edge of the upper on the upper surface of said footbed with the lower marginal edge of the upper seated within the groove and said fingers extending through respective ones of said slots, folding the portions of said fingers extending through said slots over onto the lower surface of said footbed, and securing the outsole at its upper surface to the lower surface of the footbed and the folded portions of said fingers, said groove receiving and concealing from view the lower marginal edge of the upper.

10. A method as set forth in claim 9 including the step of providing a mid-sole between the footbed and the outsole, securing an upper surface of the mid-sole to the lower surface of the footbed and the folded portions of the fingers and securing a lower surface of the mid-sole to the upper surface of the outsole.

11. A method as set forth in claim 10 including the step of providing recesses in the lower surface of the footbed and/or the upper surface of the mid-sole for receiving the folded portion of the fingers.

* * * * *